US008939609B2

(12) United States Patent
McRae

(10) Patent No.: US 8,939,609 B2
(45) Date of Patent: Jan. 27, 2015

(54) METHOD AND APPARATUS FOR CONTROLLING MULTI-COLORED LIGHT STRINGS

(71) Applicant: Michael M. McRae, Ormond Beach, FL (US)

(72) Inventor: Michael M. McRae, Ormond Beach, FL (US)

(73) Assignee: National Christmas Products, Cranford, NJ (US)

( * ) Notice: Subject to any disclaimer, the term of this patent is extended or adjusted under 35 U.S.C. 154(b) by 112 days.

(21) Appl. No.: 13/986,061

(22) Filed: Mar. 28, 2013

(65) Prior Publication Data

US 2014/0077711 A1 Mar. 20, 2014

Related U.S. Application Data

(60) Provisional application No. 61/685,967, filed on Mar. 28, 2012.

(51) Int. Cl.
*F21S 4/00* (2006.01)
*H05B 33/08* (2006.01)

(52) U.S. Cl.
CPC ..... *H05B 33/0857* (2013.01); *H05B 33/08* (2013.01)
USPC ..... 362/249.12; 362/249.14

(58) Field of Classification Search
USPC ..... 362/565, 644, 647, 249.14, 249.16, 362/311.3; 315/192, 185 S
See application file for complete search history.

(56) References Cited

U.S. PATENT DOCUMENTS

2009/0190341 A1* 7/2009 Galli et al. ..... 362/205
2011/0122609 A1* 5/2011 Dahlin ..... 362/184

* cited by examiner

*Primary Examiner* — Minh D A
(74) *Attorney, Agent, or Firm* — Brian K. Johnson, Esq., LLC

(57) ABSTRACT

A rotary switch is provided for controlling an attached light string containing a plurality of light colors. By manipulation of the control dial, a specially designed rotary board is rotated to provide electrical connection to the light string according to one of several present color patterns preprogrammed into the rotary board. The discrete rotary switch positions provided by the rotary switch allow for different color signaling patters to be provided at the output leads from the rotary switch so as to power a multicolored light staring with different patterns and create different multicolored effects. One of the discrete rotary switch positions permits the input color patter from an input light string to be passed through the rotary switch so as to provide the same color pattern at the output leads and power a multicolored light string with the same color pattern provided by the input light string.

2 Claims, 11 Drawing Sheets

METHOD AND APPARATUS FOR CONTROLLING MULTI-COLORED LIGHT STRINGS

CROSS REFERENCE TO RELATED APPLICATIONS

This application claims priority to and the benefit of U.S. Provisional Patent Application No. 61/685,967 filed Mar. 28, 2012 titled "Rotary Universal Switch" which is incorporated by reference herein in its entirety.

STATEMENT REGARDING FEDERALLY SPONSORED RESEARCH OR DEVELOPMENT

Not applicable.

BACKGROUND OF THE DISCLOSURE

1. Field of the Invention

The invention is directed to a system and method for providing a rotary switch mechanism for use in selecting color patterns to be displayed on an attached light string.

2. Description of the Prior Art

Low voltage, low power LED light strings are becoming increasingly popular in holiday decorations. One of the complications in arranging light string systems, however, is how to provide independent color control at each light string, or alternatively allow certain pass through functions so that a "follower" light string may follow the color pattern provided by a "leader" light string. In providing such functions, however, financial considerations often drive the commercial support of one or the other "pattern selection modules" since the cost of the lights strings themselves is relatively low. Thus the need exists for an inexpensive color patter selection device used to control light strings, and in particular, holiday light strings.

SUMMARY OF THE INVENTION

In one particularly preferred embodiment of the present invention, a rotary switch for controlling a light string is provided and includes: an input board for receiving power, the input board conditioning the power to provide output DC power at a pair of output power leads; an output board connected to a light string at a pair of color signal leads; a rotary board having a first side and a second side and disposed between the input board and the output board, the first side of the rotary board facing the input board and having a plurality of concentric annular conductive rings, the concentric annular conductive rings making electrical contact with a pair flexible electrical connectors coupled to the input board and the pair of output power leads, the second side of the rotary board facing the output board and having a plurality of custom electrical connection patterns on the bottom side, the rotary board having electrical conductors extending through the rotary board so as to electrically connect the plurality of concentric annular conductive rings to the plurality of custom electrical connection patterns, the plurality of custom electrical connection patterns making electrical contact with a pair flexible electrical connectors coupled to the output board and the pair of color signal leads; and the rotary switch providing a variable DC power pattern to the light string according to electrical connections made with the plurality of custom electrical connection patterns. Further, the input board may include an AC-to-DC converter for providing the DC power at the pair of output leads.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, in which.

DETAILED DESCRIPTION

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention.

It is also to be understood that the present invention or portions thereof may be implemented in various forms of hardware, software, firmware, special purpose processors, or a combination thereof. Preferably, the present invention is implemented in hardware possibly containing software as a program tangibly embodied on a program storage device. The program may be uploaded to, and executed by, a machine comprising any suitable architecture. Preferably, the machine is implemented on a computer platform having hardware such as one or more central processing units (CPU), a random access memory (RAM), and input/output (I/O) interface(s). The computer platform also includes an operating system and microinstruction code. The various processes and functions described herein may either be part of the microinstruction code or part of the program (or combination thereof) which is executed via the operating system. In addition, various other peripheral devices may be connected to the computer platform such as an additional data storage device and a printing device.

It is to be understood that, because some of the constituent system components and method steps depicted in the accompanying figures are preferably implemented in software, the actual connections between the system components (or the process steps) may differ depending upon the manner in which the present invention is programmed. Specifically, any of the computers or devices may be interconnected using any existing or later-discovered networking technology and may also all be connected through a lager network system, such as a corporate network, metropolitan network or a global network, such as the interne.

Those of skill in the art will appreciate that while the description provided below specifically recites multicolored LED light strings, the general teachings of the invention are applicable to other multicolored light string systems using other types of light strings, such as incandescent bulbs, phosphorescent bulbs, luminescent bulbs, and other electric bulbs. It is also understood that other light bulb types and lighting technologies may require modification so as to function properly in connection with the present invention.

Figure 1:
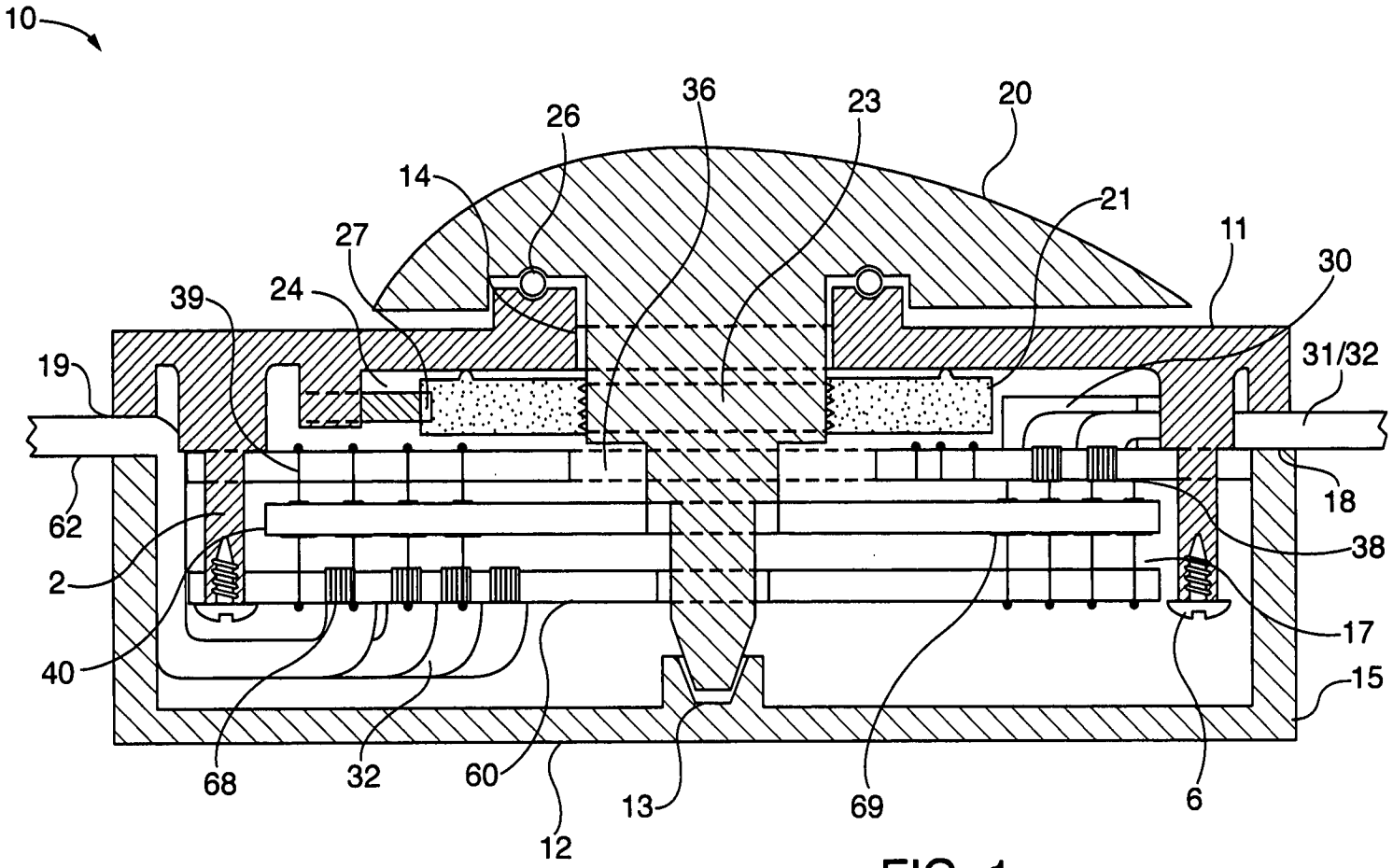
FIG. 1 shows a cross sectional side view of the rotary switch according to one embodiment of the system and method of the present invention.

FIG. 1 shows a cross sectional side view of the rotary switch 10 having a outer casing 15 with a bottom portion 12 containing a knob receiving mount 13 on the inside of the casing. Rotatable knob 20 is provided at the outer casing top 11 and central spindle 23 of rotatable knob 20 is inserted into hole 14 provided in the top portion of casing 15. The bottom tip of central spindle 23 is inserted into and retained by knob receiving mount 13. The knob 20 rests on ball bearings 26 which are provided in a groove (not shown) disposed around the circumference of hole 14. Knob 20 is secured in position by retaining nut 21 which has switch position dents 27 disposed around its outer circumference. Spring or other flexible element 24 slides along the outer circumference of knob 20 as it is rotated and flexibly locks the angular position of the knob 20 and central spindle so as to provide discrete and easily identified registration points during knob rotation as further described below.

Input power signal leads 31 and input color signal leads 12 (hidden behind the power signals in FIG. 1) are provided at the right side of the rotary switch casing 15 through opening 18. These signals are provided as inputs to input board 30 described below. Leaf springs or other flexible electrical connectors (brushes, wires, bands) 38 are mounted to via holes in the input board 30 and provide electrical connection between those vias and the top surface of rotary board 40. Complementing balancing springs 39 are provided on the other side of the input board 30 and make physical contact at the top surface of rotary board 40 to provide balance to the rotary board during rotational operation. Input board 30 is fixably mounted to the upper surface of the inside portion of casing 15 with mounting pegs 2. Hole 36 is provided in input board 30 to allow central spindle 23 to pass through the board. Rotary board 40 is mounted to the central spindle 23 by any of a variety of means including the use of a keyed hole in the rotary board.

Output color signals leads 62 are provided at the left side of the rotary switch casing 15 through opening 19. These signals are provided as outputs from the output board 60 described below. Leaf springs or other flexible electrical connectors (brushes, wires, bands) 68 are mounted to via holes in the output board 60 and provide electrical connection between those vias and the bottom surface of rotary board 40. Complementing balancing springs 69 are provided on the other side of the output board 60, make physical contact with the bottom surface of rotary board 40 and provide balance to the rotary board during rotational operation. Output board 60 is fixably mounted to the casing 15 and mounting pegs 2 with screws 6. Output board hole 66 is provided for allowing central spindle 23 to pass through the board.

Figure 2:
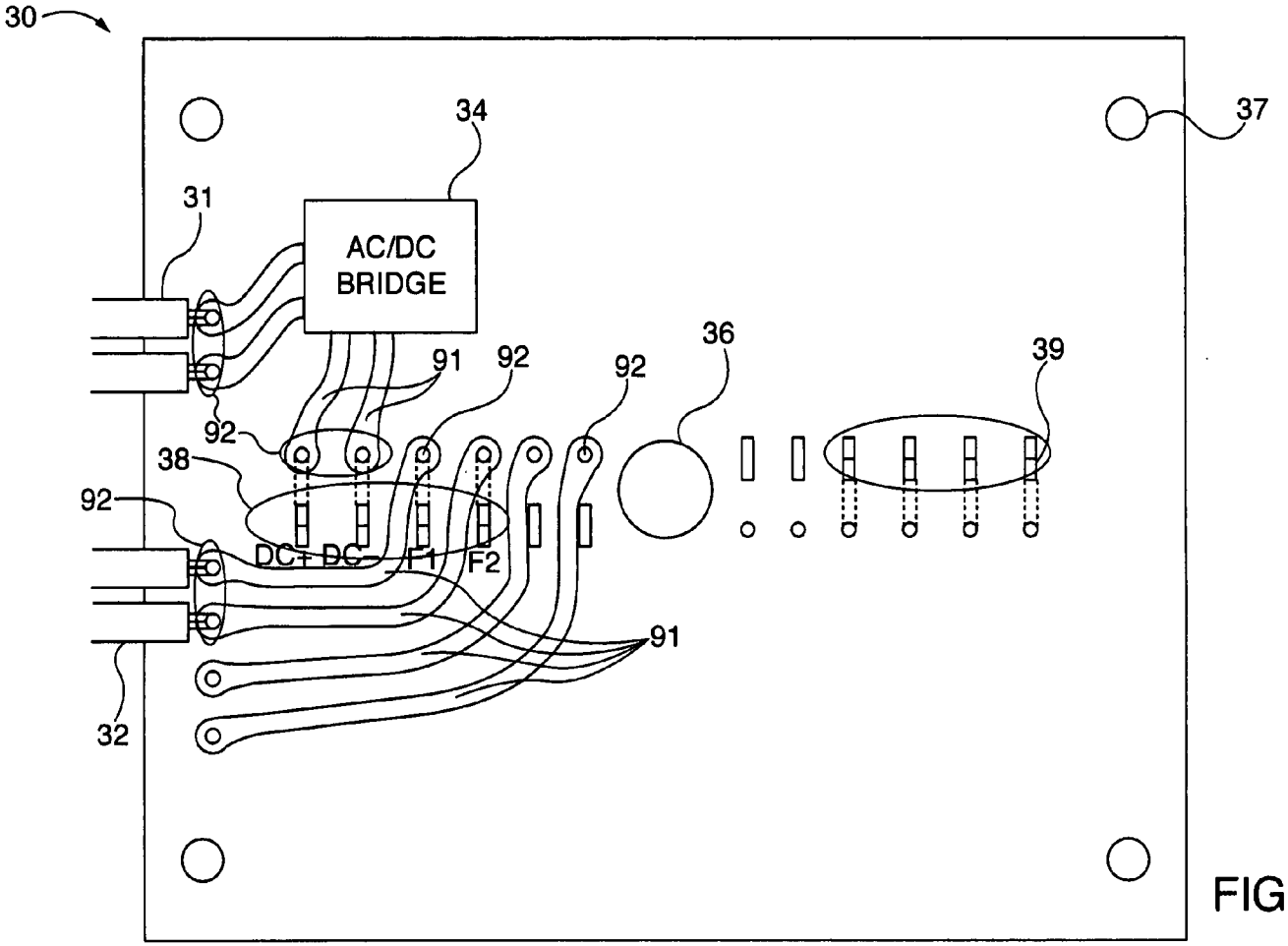
FIG. 2 shows the upper surface of the input board included in the rotary switch according to one embodiment of the system and method of the present invention.

FIG. 2 shows the upper surface of the input board 30. In one preferred embodiment of the invention, input board 30, output board 60 and rotary board 40 are printed circuit boards (PCBs) or printed wiring board (PWBs). Two sided PCBs are composed of an electrically insulating material. Deposited on either or both sides of the PCBs are lands 91 which consist of deposited layers of metal. Copper, silver, or any other liquefiable conductor may be used to deposit a land. Vias 91 are holes extending through the PCB that are filled with the liquefiable conductor such that electrical connection is made from one side of the PCB to the other through the vias. Finally, leads or wires may be inserted into open vias to provide electrical connection between the leads and the lands connected to those vias. Input power signal leads 31 and input color signal leads 32 are connected to input board 30 in this manner as shown in FIG. 2. Also shown there are mounting holes 37 for securing the input board 30 to the casing 15 and center hole 36 through which the central spindle 23 of knob 20 is disposed. As described in connection with FIG. 1 above, leaf springs or other flexible electrical connectors (brushes, wires, bands) 38 are mounted to via holes on the input board 30 and are shown as hidden lines since they extend below the bottom surface of the input board. (See FIG. 1.) These flexible connectors provide electrical connection between lands 91 downward through input board 30 to the other side where they make contact with the top surface of rotary board 40. In this manner, input color signal leads 32 are connected to input vias which in turn are electrically coupled to lands 91 and then through the input board with vias to flexible connectors 38. The two signals provided by the input color signal leads 31 are named F1 and F2 for convenience of identification. Likewise, input power signal leads 31 are connected to input vias which in turn are electrically coupled to AC/DC converter 34 which provides output DC power via additional lands then through the input board with vias to flexible electrical connectors 38. The two signals provided by the input power signal leads 31 are named DC+ and DC− for convenience of identification. Complementary balancing springs 39 are provided on the other side of the input board 30, and although not electrically connected to anything, they make physical contact with the top surface of rotary board 40 to provide balance to the rotary board during rotational operation.

Figure 3:
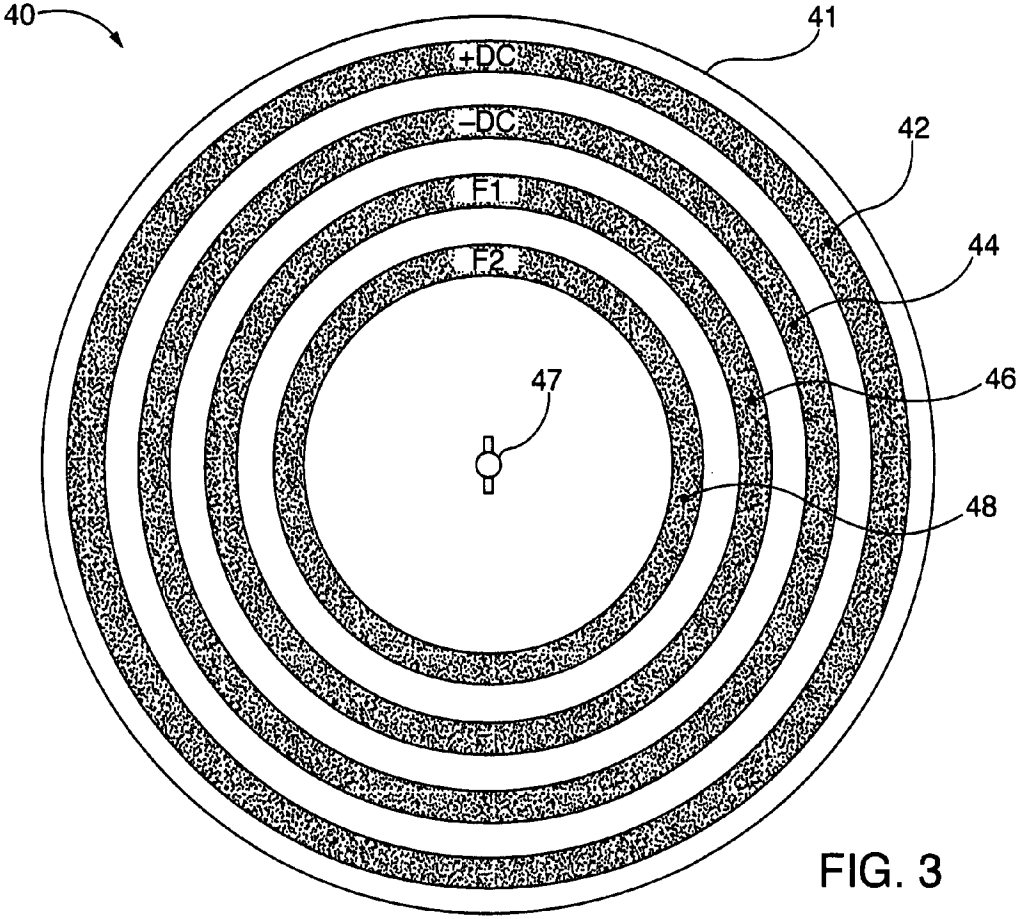
FIG. 3 shows the upper surface of the rotary board included in the rotary switch according to one embodiment of the system and method of the present invention.

FIG. 3 shows the upper surface 41 of the rotary board 40 which includes four concentric annular conductive rings or lands 42, 44, 46, 48. These lands are labeled with the signal labels provided above since each of those electrical signals are available anywhere on the ring on which they are identified. This allows for rotation of the knob 20 and rotary board 40 which maintains contact with flexible conductor 38 so as to continuously provide the indicated signals. Central keyed-hole 47 is provided in rotary board 40 for central spindle 23 to pass through. The keyed hole prevents any slippage as between the rotary board 40 and the central spindle 23 during rotation of the rotary board 40.

Figure 4:
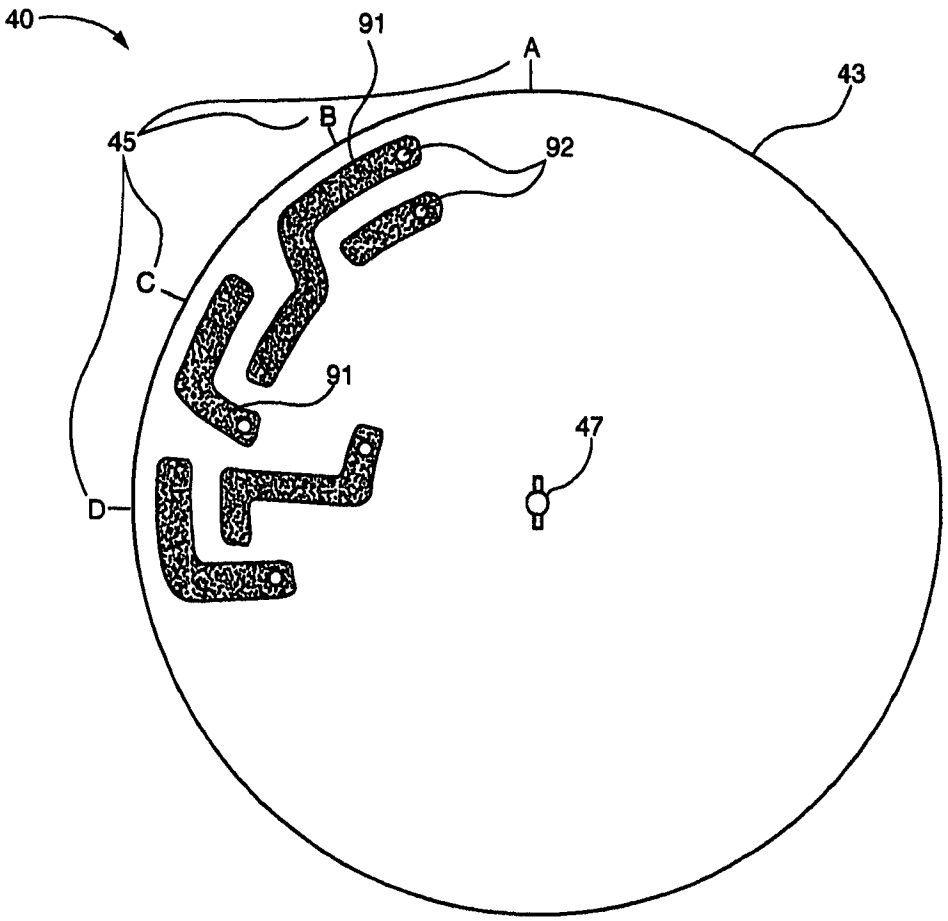
FIG. 4 shows the lower surface of the rotary board included in the rotary switch according to one embodiment of the system and method of the present invention.

FIG. 4 shows the lower surface 43 of the rotary board 40. Vias 92 are shown which extend the four electrical signals distributed by annular rings 42, 44, 46 and 48 from the first side 41 to the second side 43 of rotary board and thereafter to lands 91. Lands 91 are customized and specially designed and deposited with respect to size and geometry so as to make proper electrical connection between the input board 30 and output board 60 as described in connection with FIG. 5. Angular position markers 45, which are not a part of the rotary board 40 per se, indicate four registered stopping positions of the rotary board through the use of attached knob and in connection with spring 24 described above in connection with FIG. 1.

Figure 5:
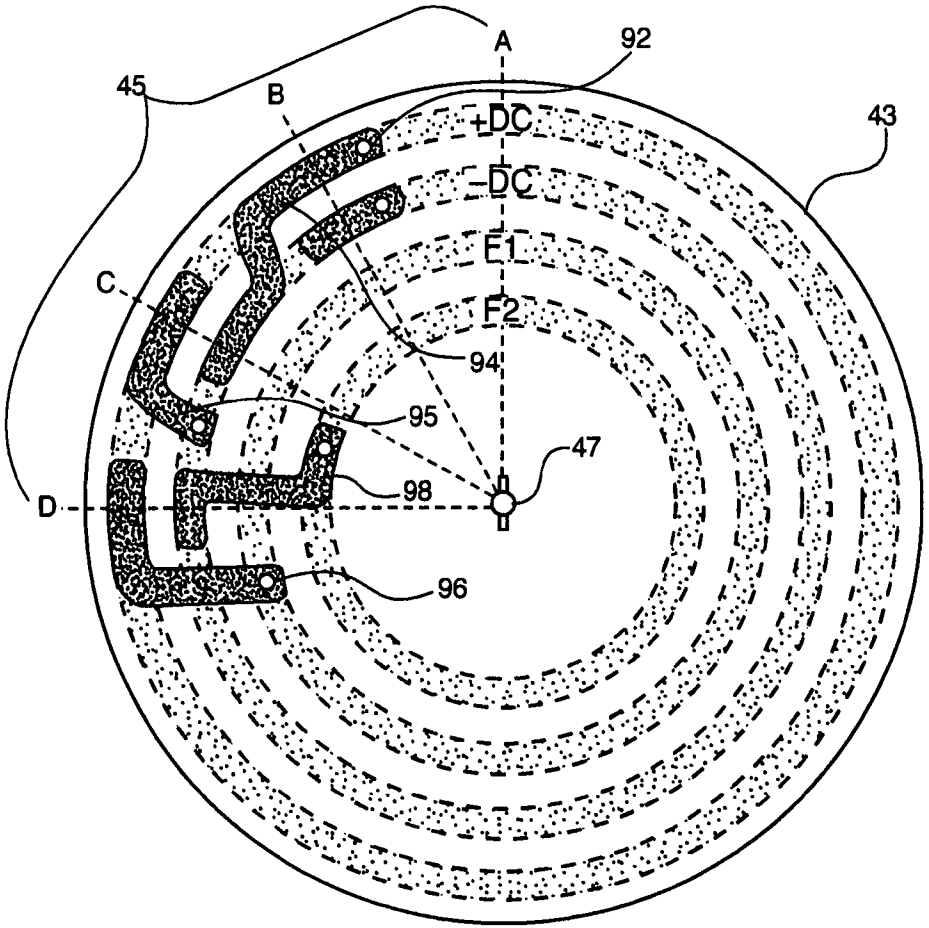
FIG. 5 is an overlay showing both the upper and lower surfaces of the rotary board included in the rotary switch according to one embodiment of the system and method of the present invention.

FIG. 5 shows the lower surface 43 of rotary board 40 with the concentric annular conductive rings 42, 44, 46, 48 of top side 41 superimposed on top of the lands as indicated by hidden lines. Vias 92 provide electrical connection between the two sides such that the following conductive pattern emerges: land 94 distributes DC+ power signaling; lands 95 distribute DC− power signaling; land 96 distributes F1 color control signaling; and land 98 distributes F2 color control signaling.

Figure 6:
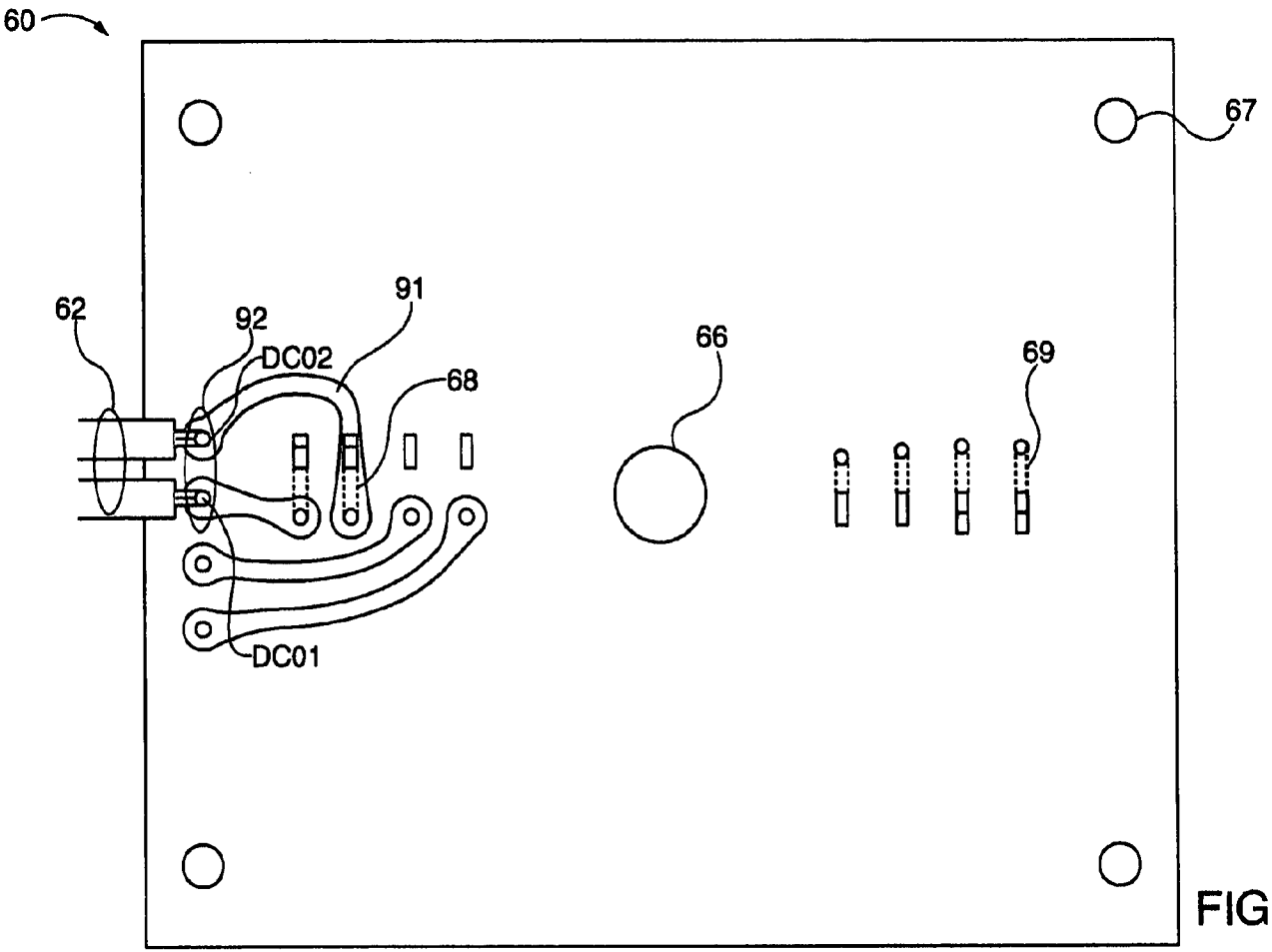
FIG. 6 shows the upper surface of the output board included in the rotary switch according to one embodiment of the system and method of the present invention.

Similar in design to the input board provided in FIG. 2, FIG. 6 shows the upper surface of the output board 60. Mounting holes 67 are provided for securing the output board 60 to the casing 15 and center hole 66 is provided through which the central spindle 23 of knob 20 is disposed. Output color signal leads 62 are connected to output board 60 at vias 92. Lands 91 provide electrical connection between the output color leads and flexible electrical connectors 68 that are coupled to the output board 60 via holes in the output board 60. These flexible conductors provide electrical connection between those vias and the bottom surface of rotary board 40. For convenience, the output color signals are identified as DCO1 and DCO2. Complementing balancing springs 69 are provided on the other side of the output board 60 and make physical contact the bottom surface of rotary board 40 to provide balance to the rotary board during rotational operation.

FIGS. 1-6 provide a rotary switch mechanism by which a two-color light string may be powered and controlled. Such control may include a bypass or "following" feature. To accommodate this, an electrical connection to the two wires of a two color input LED light string is provided at input color control leads 32. Similarly, electrical connection to the two wires of a two-color output LED light string is provided at output color control leads 62. Each of the two color light strings has LED bulbs that include two different colored LEDs that are connected anode-to-cathode. When a positive DC biasing signal is provided to either LED light string, the LEDs within each bulb that are positively biased are triggered.

In operation, the rotary switch operates in the following manner. Flexible electrical connectors 38 carry the signals DC+ and DC− provided by the input board as conveyed and conditioned from the input power signal leads 31 and signals F1 and F2 from the input color signal leads 32. By proper spacing of the rotary board under the springs 38, these four signals are presented on the four concentric annular lands 42, 44, 46 and 48 on the top surface 41 of rotary board 40. Vias distribute these signals to the bottom surface 43 of the rotary board 40 where customized and uniquely constructed lands 94, 95, 96 and 98 are provided to further distribute the signaling. Realizing that the flexible contacts 68 on the output board are in registered alignment with the outer most annular regions below those providing DC+ and DC− such that the spring and lead carrying signal DCO1 is under DC+ and the spring and lead carrying signal DCO2 is under DC−, the final connection map is provided for each of the registered positions 45 as provided below:

| Angular position on rotary board | Signal provided at DCO1 | Signal provided at DCO2 | Resultant operation of downstream light string |
|---|---|---|---|
| A | NONE | NONE | No LEDs lit |
| B | DC+ | DC− | Positive bias LEDs lit |
| C | DC− | DC+ | Negative bias LEDs lit |
| D | F1 | F2 | Follows input LED light string polarity |

In this manner, the rotary switch of the present invention may be simply and inexpensively constructed wherein several discrete switch positions are provided on the switch to automatically select a particular predetermined LED light string color pattern, or alternatively allow a "leader" LED light string to drive the color scheme for other "follower" LED light strings through the rotary switch so as to maintain a homogeneous LED light string display.

The basic concepts provided above with respect to the control of a two color LED light string with a rotary switch may be extended to more sophisticated LED light strings, for example, those containing 4 or 6 different colored LEDs in each bulb. In a four-colored LED bulb, three color signal leads are required within the light string to activate all four colors. In a six-colored LED bulb, four color signal leads are required within the light string to activate all six colors. A brief description is provided below of rotary controllers to accomplish the above-recited functions for the four color LED lighting systems. Only the differences from the two colored LED system are highlighted with the understanding that common portions of the systems are constructed and operate as described above.

Figure 7:
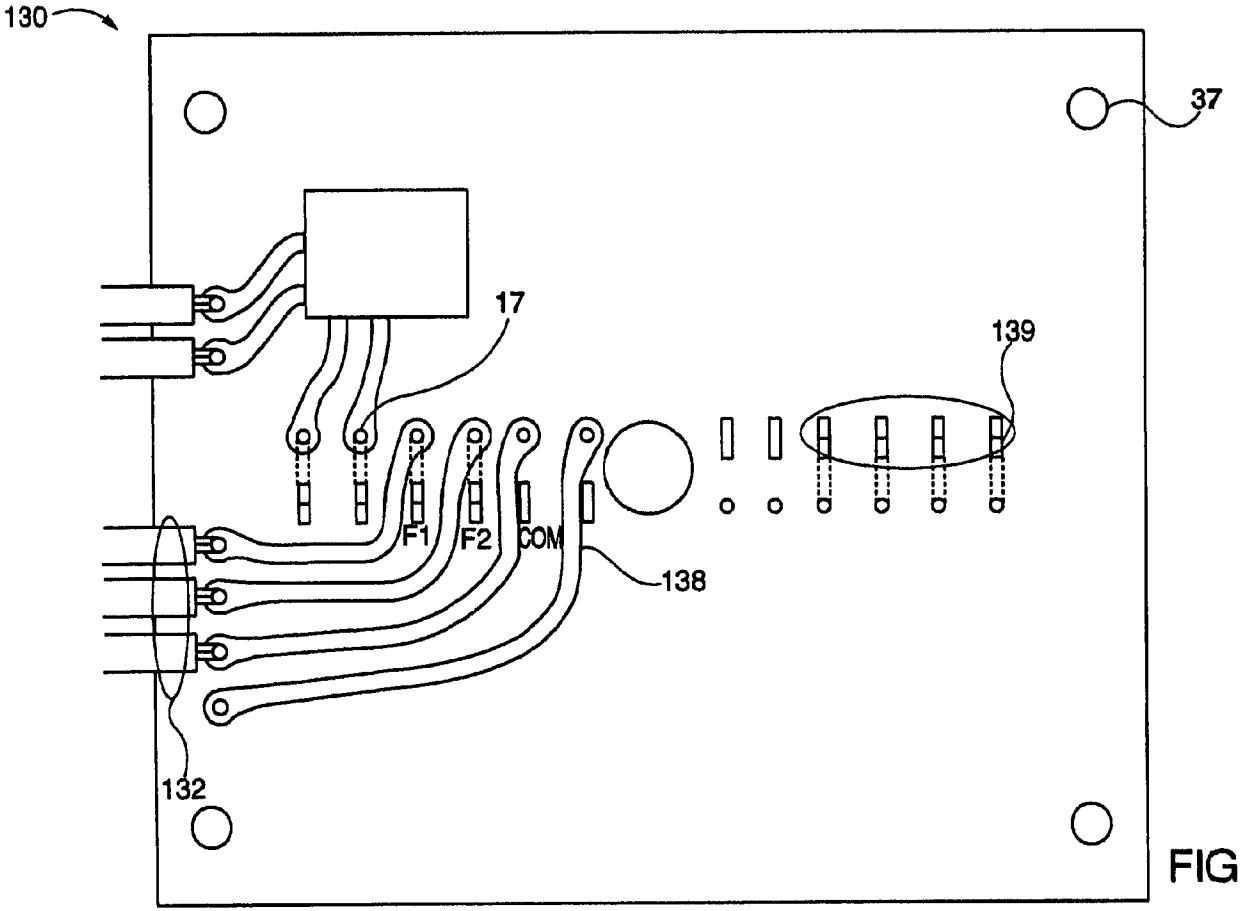
FIG. 7 shows the upper surface of the input board included in the rotary switch according to one embodiment of the system and method of the present invention.
Figure 8:
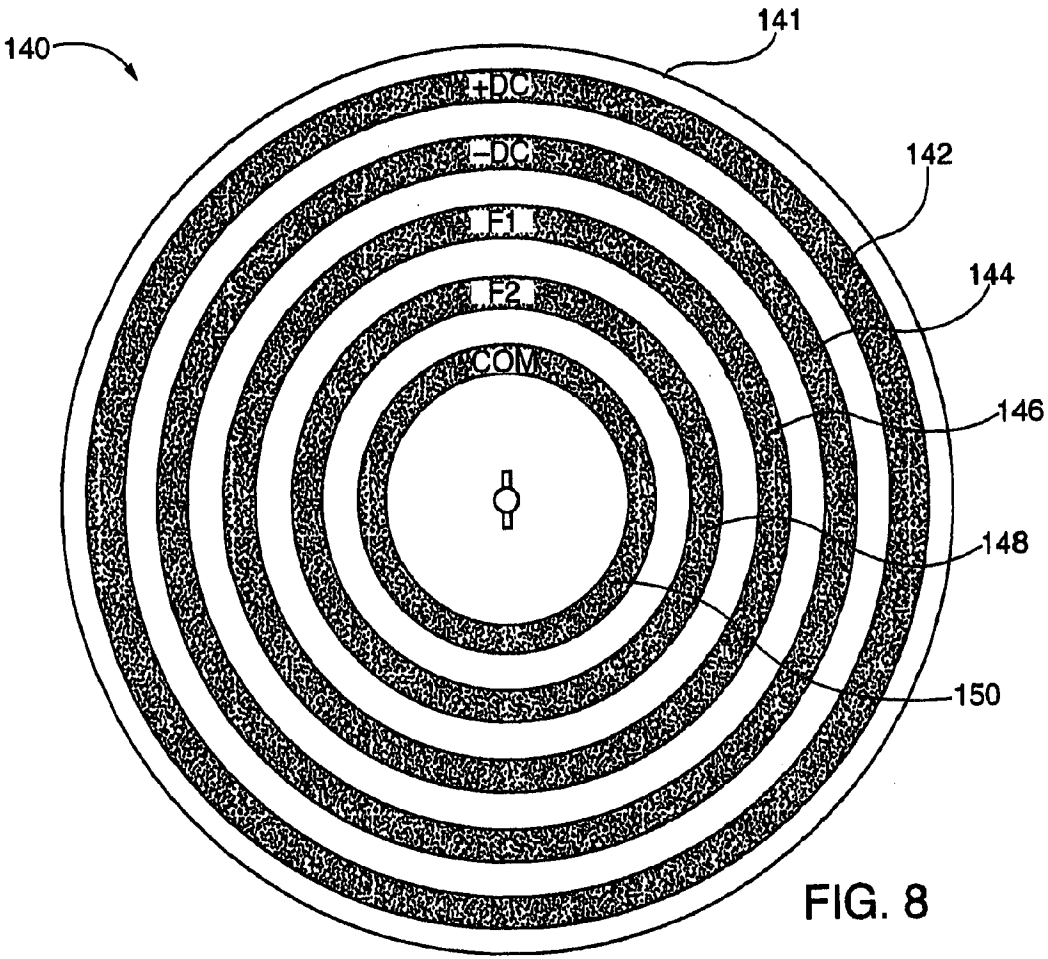
FIG. 8 shows the upper surface of the rotary board included in the rotary switch according to another embodiment of the system and method of the present invention.
Figure 9:
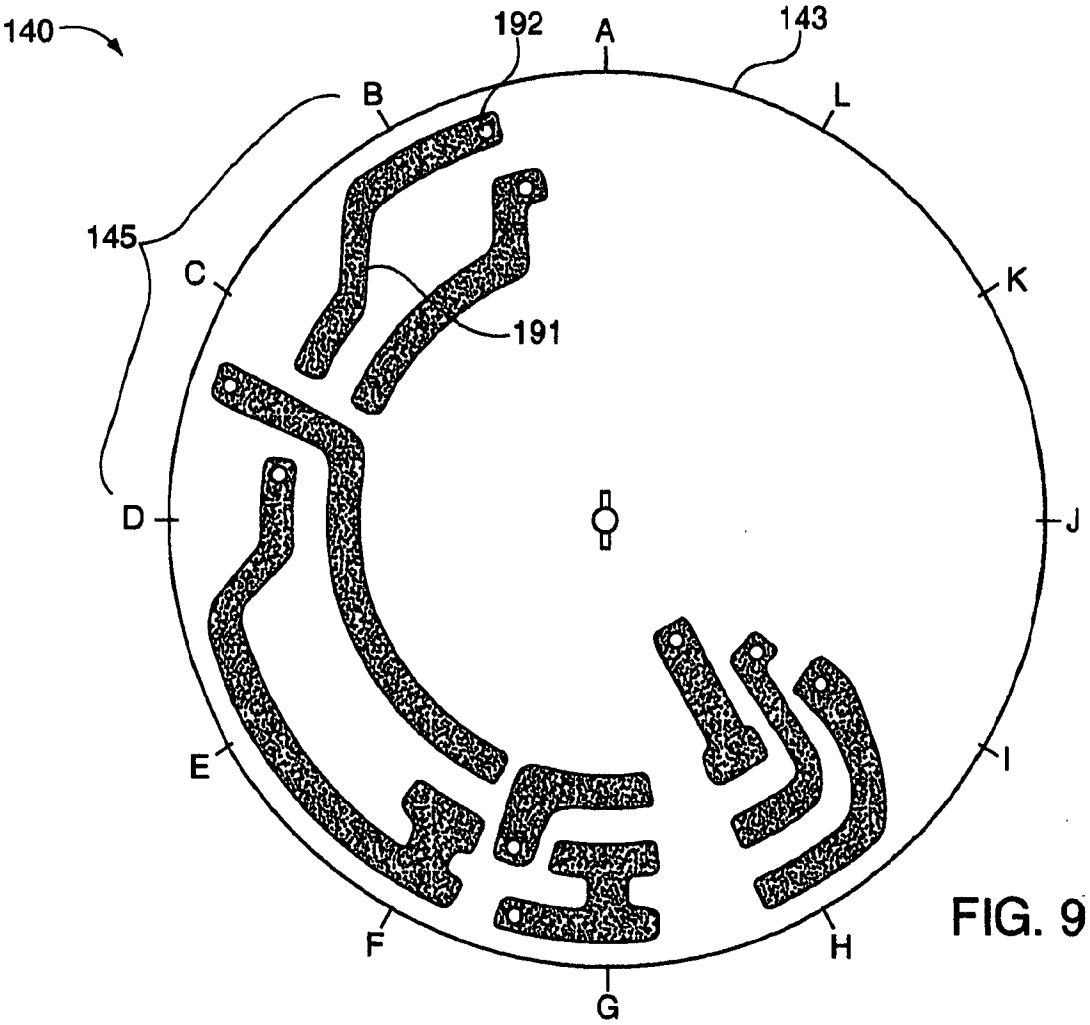
FIG. 9 shows the lower surface of the rotary board included in the rotary switch according to another embodiment of the system and method of the present invention.
Figure 10:
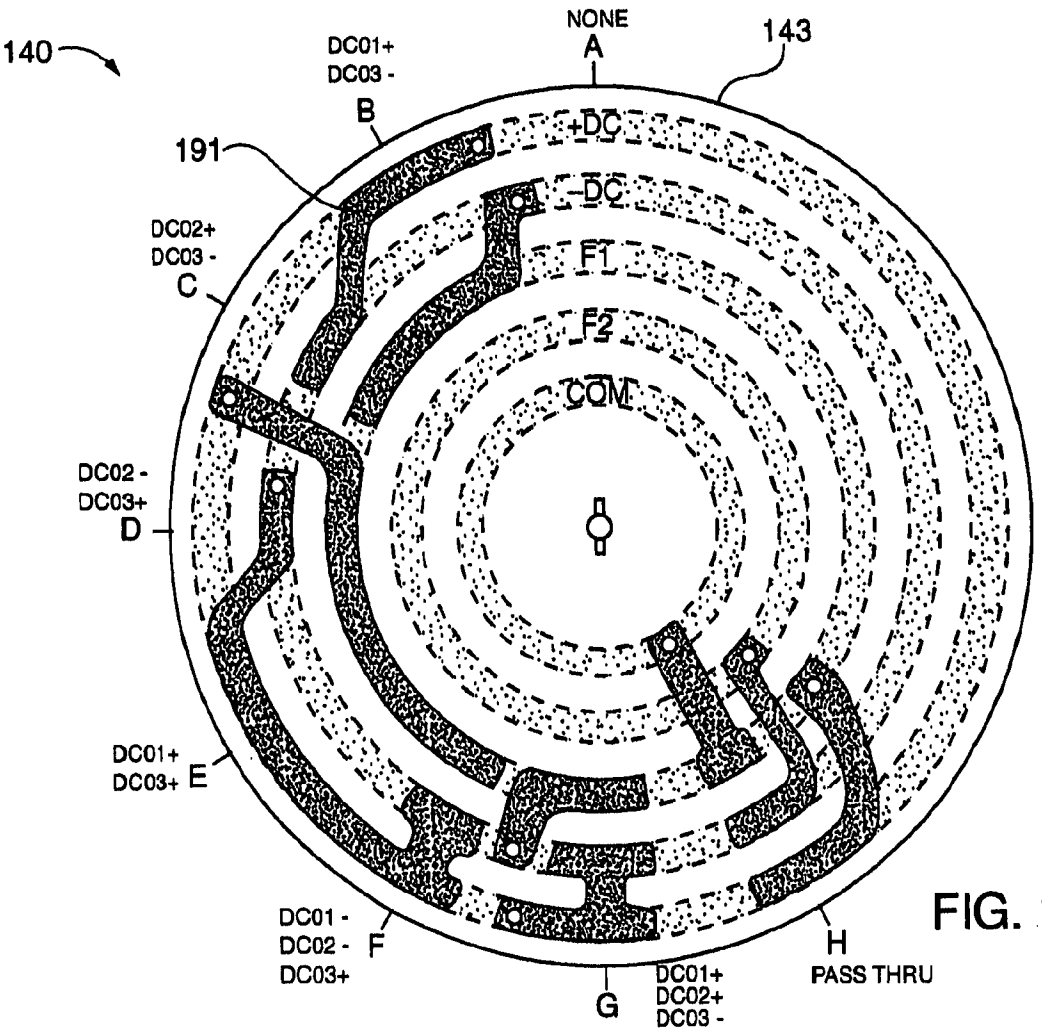
FIG. 10 is an overlay showing both the upper and lower surfaces of the rotary board included in the rotary switch according to another embodiment of the system and method of the present invention.
Figure 11:
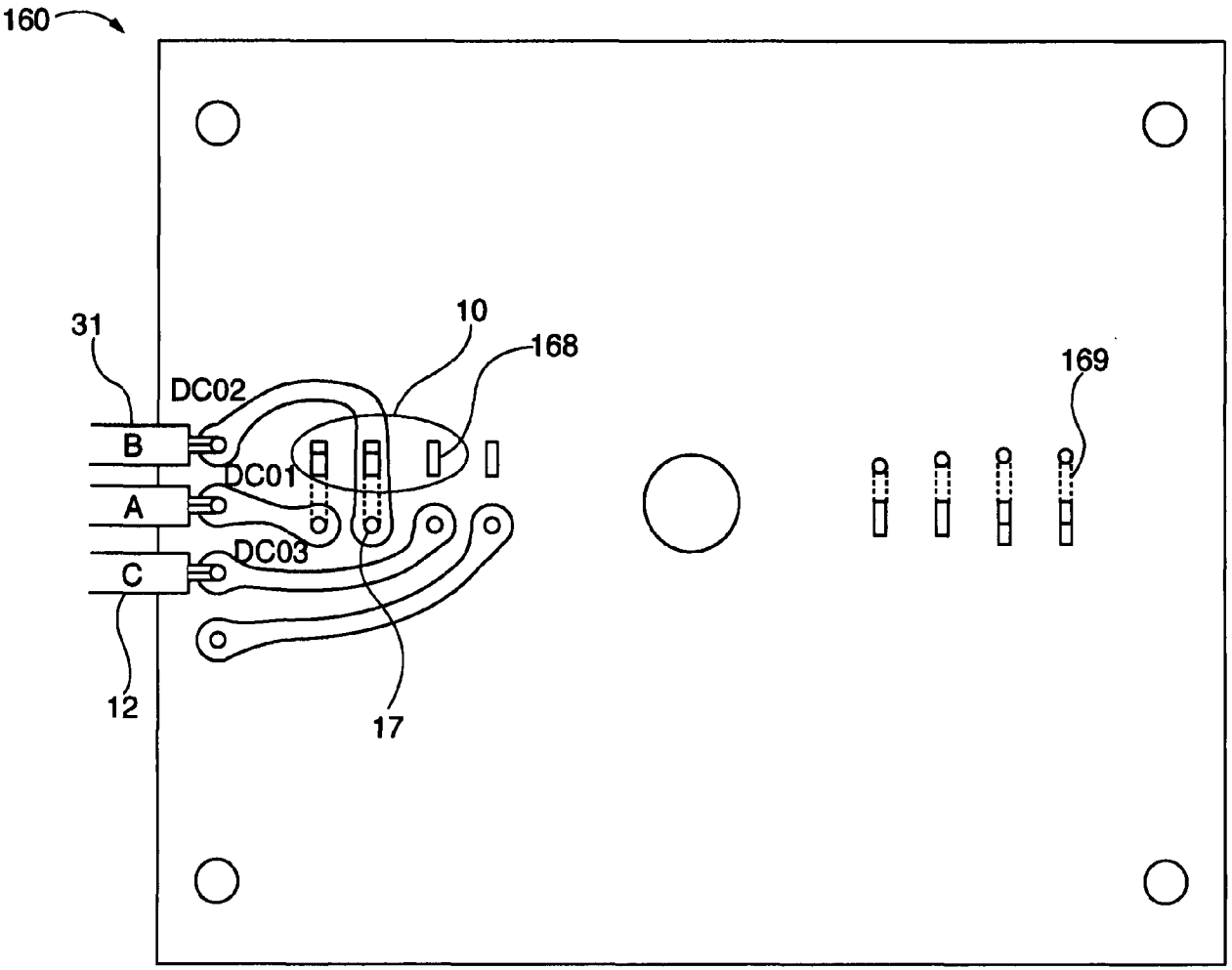
FIG. 11 shows the upper surface of the output board included in the rotary switch according to another embodiment of the system and method of the present invention.

First, the rotary switch 10 provided in FIG. 1 does not require significant modification in order to handle larger LED string systems, which is one of the advantages of present invention over other solutions. In particular and as mentioned above, in a four color LED lighting system three input power color signal leads 132 will be brought from the input light string as inputs color signals to input board 130. FIG. 7. The three input color signal leads result in three springs being needed to convey the color signals F1, F2 and COM to the upper surface 141 of rotary board 140. FIG. 8. These three springs, in combination with the two springs providing input power signals, raise the total to five springs 138 extending beneath input board 130 that provide electrical contact with five annular corresponding lands 142, 144, 146, 148 and 150 on upper surface 141 of rotary board 140. FIG. 8. Again, upper annular regions of electrical connectivity at the upper surface 141 are extended to lower surface 143 with vias 192 where custom, geometrically designed lands 191 are provided to further distribute the five signals to the bottom surface at appropriate contact points corresponding to switch stopping positions 145. FIG. 9. The rotary board 140 showing the overlaid lands 191 and five annular land regions for the four color rotary switch is provided in FIG. 10. Realizing that the contact springs 168 on the output board 160, which are now three in number, are in registered alignment with the outer most annular regions below those providing DC+, DC− and F1 such that the spring and lead carrying signal DCO1 is under DC+, the spring and lead carrying signal DCO2 is under DC−, and the spring and lead carrying signal DCO3 is under DC+. The final connection map is provided for each of the registered positions 145 as provided below:

| Angular position on rotary board | Signal provided at DCO1 | Signal provided at DCO2 | Signal provided at DCO3 | Resultant operation of downstream light string |
|---|---|---|---|---|
| A | NONE | NONE | NONE | No LEDs lit |
| B | + | | − | DCO1 positively biased with respect to DCO3 |
| C | | + | − | DCO2 positively biased with respect to DCO3 |
| D | | − | + | DCO3 positively biased with respect to DCO2 |
| E | − | | + | DCO3 positively biased with respect to DCO1 |
| F | − | − | + | DCO3 positively biased with respect to DCO1 and DCO2 |
| G | + | + | − | DCO1 and DCO2 positively biased with respect to DCO3 |
| H | F1 | F2 | COM | Follows input LED light string polarity |

It should be understood that the ultimate illumination pattern resulting on the four color light string will depend on the construction and arrangement of the four LED light bulbs, their positions on the string etc. For guidance in this regard, the applicant's copending U.S. patent application directed to an All Holidays Lighting System may be consulted as described in U.S. patent application Ser. No. 13/694,754 entitled Apparatus and Method for Controlling LED Light Strings, filed Dec. 31, 2012.

Additional balancing springs 139 and 169 may be provided on input board 130 and output board 160 as desired or required due to the addition of color signal springs. Finally, the four LED light string arrangement may be extended to larger more color divers systems by application of the teachings of this disclosure.

It should be appreciated that by simply changing the rotary board with a differently configured rotary board, different interconnection patterns and resultant biases may be achieved to drive light string illumination and/or provide pass-through functionality from a "leader" string. It is also important to note that the input and output boards and most other parts of the rotary switch are identical in construction with only the number of springs and type of rotary board used being changed to significantly change the functionality of the rotary switch. In fact, a single rotary board can be configured to accommodate a plurality of colored light string systems of differing numbers of LED colors all within one unit.

Although various embodiments, which incorporate the teachings of the present invention have been shown and described in detail herein, those skilled in the art can readily devise many other varied embodiments that still incorporate these teachings.

What is claimed is:

1. A rotary switch for controlling a light string, said rotary switch comprising:

an input board for receiving power, said input board conditioning said power to provide output DC power at a pair of output power leads;

an output board connected to a light string at a pair of color signal leads;

a rotary board having a first side and a second side and disposed between said input board and said output board, said first side of said rotary board facing said input board and having a plurality of concentric annular conductive rings, said concentric annular conductive rings making electrical contact with a pair flexible electrical connectors coupled to said input board and said pair of output power leads, said second side of said rotary board facing said output board and having a plurality of custom electrical connection patterns on said bottom side, said rotary board having electrical conductors extending through the rotary board so as to electrically connect said plurality of concentric annular conductive rings to said plurality of custom electrical connection patterns, said plurality of custom electrical connection patterns making electrical contact with a pair flexible electrical connectors coupled to said output board and said pair of color signal leads; and said rotary switch providing a variable DC power pattern to said light string according to electrical connections made with said plurality of custom electrical connection patterns.

2. The rotary switch of claim 1 wherein said input board includes an AC-to-DC converter for providing said DC power at said pair of output leads.

* * * * *